United States Patent [19]

Van den Bergh

[11] 4,243,215

[45] Jan. 6, 1981

[54] PAPER FOLDING AND CONVEYING APPARATUS AND METHOD

[75] Inventor: Marc F. S. M. Van den Bergh, Zele, Belgium

[73] Assignee: Miller-Johannisberg Druckmaschinen GmbH, Wiesbaden, Fed. Rep. of Germany

[21] Appl. No.: 934,624

[22] Filed: Aug. 17, 1978

Related U.S. Application Data

[63] Continuation-in-part of Ser. No. 824,607, Aug. 15, 1977, abandoned.

[30] Foreign Application Priority Data

Sep. 15, 1976 [BE] Belgium ..... 169.851

[51] Int. Cl.[3] ..... B65H 45/20

[52] U.S. Cl. ..... 493/422; 493/436

[58] Field of Search ..... 270/61 F, 79, 73, 69, 270/39; 198/460

[56] References Cited

U.S. PATENT DOCUMENTS

| | | | |
|---|---|---|---|
| 3,067,997 | 12/1962 | Gearheart | 270/79 |
| 3,086,768 | 4/1963 | Lach | 270/79 |
| 3,219,202 | 11/1965 | Huffman | 270/79 X |
| 3,751,873 | 8/1973 | Toby | 198/460 X |
| 3,912,252 | 10/1975 | Stephens | 270/79 |

FOREIGN PATENT DOCUMENTS

| | | | |
|---|---|---|---|
| 2506901 | 8/1975 | Fed. Rep. of Germany | 270/79 |

*Primary Examiner*—Edgar S. Burr
*Assistant Examiner*—A. Heinz
*Attorney, Agent, or Firm*—E. Wallace Breisch

[57] ABSTRACT

A paper folding and conveying apparatus and method and more particularly an improved apparatus and method for the high speed conveying of paper strip and imparting an overlying fold thereto.

15 Claims, 3 Drawing Figures

PAPER FOLDING AND CONVEYING APPARATUS AND METHOD

CROSS-REFERENCES TO RELATED APPLICATIONS

This application is a continuation-in-part of U.S. patent application Ser. No. 824,607, filed Aug. 15, 1977, now abandoned.

BACKGROUND OF THE INVENTION

In the manufacture of business forms it is common practice to print the business forms on a continuous basis in a suitable press and after such printing to continuously cross indent or perforate the business form at each end so that upon subsequent folding at such cross indent line a stack of business forms is conveyed to discharge. One common business form of such construction is the computer readout which consists of a stack of identical overlying forms which are separable, as desired, along one or all of the cross indent lines.

Insofar as the manufacture of these types of business forms the printing and cross indent equipment is a more or less straight line process with the folding machinery being the most critical insofar as a potential for production inefficiency. In application of such strip folding equipment utilized heretofor, the longitudinal overlying fold was often provided by directing the paper strip alternately to longitudinally spaced sets of spiral conveyors. Many arrangements of such prior strip folding equipment included a swinging or oscillating plate to alternately direct the strip to the spaced sets of spiral conveyors. By their very nature the swinging plate arrangements involved complicated machinery which was subject to wear, required adjustments, offered a frictional resistance to the smooth flow of strip, and presented a problem to be overcome when it was desired to speed up production. Still other arrangements of prior strip folding equipment have been developed which do not utilize the swinging plate arrangement; however, these alternative arrangements do not alleviate or cure other problem areas possessed by prior strip folding equipment.

In particular both the swinging plate and alternative strip folding equipment utilized heretofor have included a number of problem areas such as: the number of adjustments which were required to be made when it was desired to increase or decrease the length of strip between overlapping forms; potential frictional resistance to the strip travel at the entry to the spiral conveyors as well as during the conveying of the strip downwardly which could result in inefficient strip handling and/or smearing of the printed indecia on the strip; providing consistency accurate guiding during the critical point of the entry of the strip to the spiral conveyors; and insuring an efficient means of discharge of the stacked strip after exit from the spiral conveyors.

SUMMARY OF THE INVENTION

It is particularly to the above mentioned prior systems which the present invention is an improvement over either by negating or greatly alleviating the problems with the prior systems.

Specifically the present invention includes a means for adjusting the spacing between spiral conveyors to vary the length between folds in the strip while simultaneously adjusting the means for guiding the strip to the spiral conveyors a corresponding amount. Still further the present invention includes an arrangement wherein the entry of the strip to the spiral conveyors is to the valley intermediate the upper two flight portions regardless of the longitudinal spiral conveyor spacing thereby decreasing the strip flow resistance which would be present if the entry was at a flight outer periphery. Furthermore the present invention includes means for providing an air cushion intermediate the spiral conveyors and the strip being conveyed to further decrease frictional resistance to the strip as it is conveyed and folded by the spiral conveyors. Still further the invention herein includes an exit conveyor downwardly adjacent the spiral conveyors to receive the folded strip thereon and convey such strip to discharge. The exit conveyor includes a step therein to facilitate conveying the strip while simultaneously compressing the stacked strip somewhat to reduce the height thereof. In addition, the invention herein includes a ratio of the surface speed of the strip during the downward travel thereof to the spiral conveyors with respect to the speed of the adjacent guiding continuously rotating belts which will result in an air cushion being maintained on each side of the strip during such downward travel. This air cushion will alleviate occurances of smearing the printed indicia and will provide a more stable relatively friction free transport of the strip to the spiral conveyors.

DESCRIPTION OF THE DRAWINGS

These and other objects and advantages of the present invention will become more apparent upon a reading of the following description and drawings in which:

FIG. 1 schematically illustrates a side elevational view of a presently preferred paper conveying and folding apparatus 100 of the present invention having: a pair of longitudinally spaced conveyor assemblies 3 which continuously receive and a continuously supplied strip 57 of paper downwardly therebetween and alternately across respective lowermost runs 13 thereof; longitudinally spaced pairs of downwardly extending spiral conveyor assemblies 37 having the uppermost ends thereof outwardly adjacent conveyor runs 13 and operative to alternately receive portions of strip 57, as hereinafter described, at the uppermost ends thereof and to fold such strip 57 while conveying it downwardly; and an exit conveyor assembly 102 spaced below conveyor assemblies 37 to receive the folded strip 57 thereon for subsequent conveying. In addition to suitable supporting adjusting and driving means which will be described hereinafter, the apparatus 100 additionally includes main body end supports 2 which extend traversely between main body side supports 1.

Figure 1:
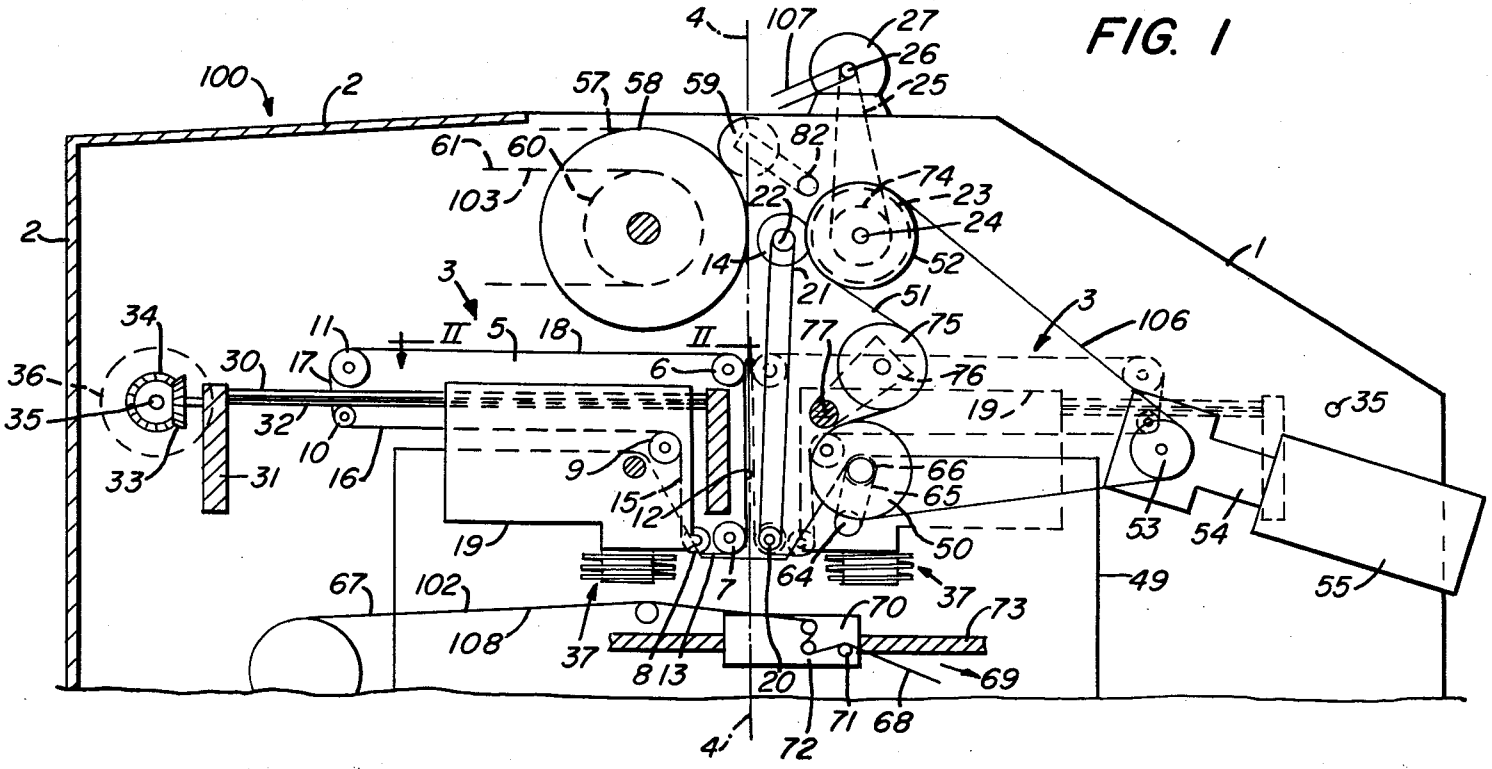
FIG. 1 is a schematic side elvational view of strip conveying and folding system constructed in accordance with the principles of the present invention.

Strip 57 is fed to conveyor assemblies 3 by means of a suitable entrance conveyor assembly 103 located upwardly of conveyor assemblies 3. Such that strip 57 is discharged downwardly therefrom between the adjacent vertically extending runs 12 of assemblies 3. Entrance conveyor 103 is of a suitable construction and as illustrated in FIG. 1 includes a rotatable feed cylinder 58 extending transversely between side supports 1 and having a chain sprocket 60 secured thereto. A driving chain 61 is trained about sprocket 60 to drive feed cylinder 58. Chain 61 is driven in any suitable manner to provide the desired rotation of cylinder 58. A rotatable roller 59 is carried intermediate side supports 1 by suitable lever arms 82 adjacent the forward end of feed cylinder 58 such that strip 57 passes intermediate cylinder 58 and roller 59 and is discharged therefrom in a smooth downwardly extending motion.

For a better understanding of this description, vertical line 4 indicates the plane of symmetry between conveyor assemblies 3 and further, for purposes of description, the left hand portion of FIG. 1 is illustrated in partial cross section with the side plate 1 removed and the right hand portion of FIG. 1 illustrates plate 1 in position and carrying various driving components. Still further the terms forward and rearward shall generally refer respectively to towards and away from line of symmetry 4 along the longitudinal extent of members 1.

Each conveyor assembly 3 is disposed intermediate side supports 1 and comprises: a plurality of transversely spaced formed loop endless belts 5 which are trained about a plurality of rotatable rollers, as illustrated 6 rollers respectively numbered 6 thru 11; and an adjusting slide guide 19. Belts 5 are trained about rollers 6 thru 11 to form: a forwardmost generally vertically extending run 12 extending between upper roller 6 and lower roller 7; a lowermost generally longitudinally extending run 13 extending between lower roller 7 and a rearwardly spaced lower roller 8 which lies at substantially the same elevation as roller 7; an intermediate substantially vertically extending run 15 extending between roller 8 and a intermediate roller 9 spaced upwardly therefrom; an intermediate generally longitudinally extending run 16 extending between roller 9 and an intermediate rear roller 10 spaced longitudinally rearwardly therefrom; a rearwardmost generally vertically extending run 17 which extends between roller 10 and an upper roller 11 spaced upwardly therefrom; and an uppermost generally longitudinally extending run 18 which extends forwardly between rollers 11 and 6, thus closing the continuous formed loop of belts 5. Rollers 6 and 8 through 11 are idler rollers and roller 7 is driven in a manner to be described hereinafter. Furthermore, rollers 6, 7, 10, 11, and 12 extend transversely between and are rotatably carried by side supports 1 and rollers 8 and 9 extend between and are rotatably carried by transversely spaced side panels 28 of slide guide 19. Side panels 28 extend longitudinally between longitudinally spaced end panels 29 of slide guide 19.

A pair of transversely spaced spiral conveyor assemblies 37 are carried by each slide guide 19 rearwardly adjacent the forward end panel 29. The longitudinally spacing between spaced pairs of spiral conveyor assemblies 37 is determinative of the length of strip 57 intermediate folds. The lower run 13 of belts 5 provide backing support, guiding and conveying for the strip 57 passing thereby to the rearwardly adjacent spiral conveyor assemblies 37. In a manner as will be more fully described hereinafter, slide guide 19 is rendered movable longitudinally to selectively increase or decrease the longitudinal distance between adjacent pairs of spiral conveyor assemblies 37. Inasmuch as rollers 8 and 9 are carried by slide guide 19 and further that the length of run 13 is defined by the longitudinal distance between rollers 7 and 8, movement of slide guides 19 for changing the longitudinal spacing between the longitudinally spaced pairs of spiral conveyor assemblies 37 will simultaneously change the critical length between rollers 7 and 8 a corresponding amount. Thus, one aspect of the invention herein provides an arrangement wherein a single adjustment will simultaneously result in a longitudinal movement of a pair of spiral conveyor assemblies with a corresponding change in the length of lower run 13 thereby providing for selective adjustment in the length of the fold in strip 57 while simultaneously maintaining conveying and backing therefor.

This single adjustment feature is of particular importance when it is desired to fold differing length forms with the apparatus 100 of the present invention. In such an instance the strip 100 would pass through a suitable press (not shown) for imprinting from indecia thereon. Thereafter the strip 100 may pass through suitable equipment to continuously cross indent or perforate the business form at each longitudinal end thereof. The distance between adjacent indents determines the length of the form and also the spacing between adjacent longitudinally spaced pairs of spirals 37 which, as hereinafter described in detail, will fold the strip 57 in an overlying fashion at the indents. When the distance between adjacent indents are increased or decreased, each slide guide 19 is moved one half of the amount of increase or decrease thereby resulting in a uniform change in the spacing between longitudinally spaced pairs of spiral conveyors 37 as well as a uniform change in the length of run 13. The invention herein does not necessitate separate adjustments for both the spirals 37 and means to direct the strip 57 to the spirals 37 as has been taught in the prior art. Furthermore it is to be additionally noted that any change in the length of lower run 13 will not in any manner effect the predetermined tension imparted to belts 5 when assembled on, or adjusted to, rollers 6–11. Still further as will be more fully described and explained hereinafter, any change in the spacing between longitudinally spaced pairs of spiral conveyors 37 will not in any manner effect the elevation of the downwardly projecting of surface of run 13 with respect to the entry to spiral conveyors 37. As will become evident from further reading this entry is positioned for minimum frictional and structural interference in the transfer of strip 57 from the conveyor assemblies 3 to the spiral conveyors 37.

A transversely spaced pair of spiral assemblies 37 are carried by each slide guide 19 inwardly adjacent the respective side panel 28 and rearwardly adjacent the respective forward end panel 29. Each spiral assembly 27 comprises: a downwardly extending elongated shaft 38 having the upper end portion thereof journaled to a suitable bearing block 39 for the coaxial rotation of shaft 38 about the longitudinal axis thereof; and a downwardly extending spiral flight 40 carried by shaft 38 adjacent the outer periphery thereof and secured thereto in any suitable manner, for example by channels 41.

With a configuration of conveyor assembies 3 and spiral conveyor assemblies 37 as discussed hereinabove strip 57 is initially threaded downwardly between adjacent vertical runs 12 to the spiral conveyor assemblies 37. After initial threading the strip 37 and during operation of apparatus 100 the strip 57 passes downwardly between vertical runs 12 and then alternately along the spaced runs 13 to the pair of spiral conveyors 37 rearwardly adjacent each run 13. More specifically the strip 57 will be directed to one or the other of the pairs of spiral conveyors 37 in a manner that the indent of a form will be directed along one run 13 to the upper entry portion of the flights 40 of a pair of spiral conveyors 37. At this moment a transversely extending somewhat rounded edge will be formed by the flights 40 as well as the effect of the indents. Simultaneously the strip 57 downstream of the indent being conveyed downwardly by the one pair of spiral conveyors 37 backs up the natural action thereof in a manner that the adjacent downstream indent is directed along the other run 13 to the upper entry portion of the flights 40 of the other pair of spiral conveyors 37. Another somewhat rounded edge of the downstream indent is then formed by the flights 40 of the other pair of spiral conveyors 37. As strip is continuously directed downwardly through adjacent runs 12, the subsequent rounded edges are alternately formed in the same manner as discussed above. Furthermore as each rounded edge is conveyed downwardly by the respective pairs of spiral conveyors 37 the radius of the rounded edges is decreased so that the strip exiting from the spiral conveyors 37 is folded in a proper manner.

The intention herein additionally teaches the concept of providing a superior entry of the strip 57 to the spiral conveyors 37 as well as maintaining this entry regardless of the longitudinal spacing between spaced pairs of spiral conveyors 37. This entry is particularly appropriate for high speed runs of strip 57, for positive guiding is provided to the strip 57 with very little friction or mechanical interferance at the entry of strip 57 to the spiral conveyors 37. The entry is provided by positioning the downwardly facing surface of the horizontally extending runs 13 at a location intermediate the opening between the upper flight portions of spiral conveyors 37 which receive the strip 57 therein to initiate folding. Thus, the strip 37 is directed from runs 13 to the respective entry of the spiral conveyors 37 without substantial frictional or mechanical interference by the spiral conveyors 37. Furthermore as discussed hereinabove with respect to the concept of slide guide 19 carrying the rollers 8 and 9 as well as a pair of spiral conveyors 37, the above described entry will be maintained throughout the longitudinal spacing adjustment of spaced pairs of spiral conveyors 37.

Figure 3:
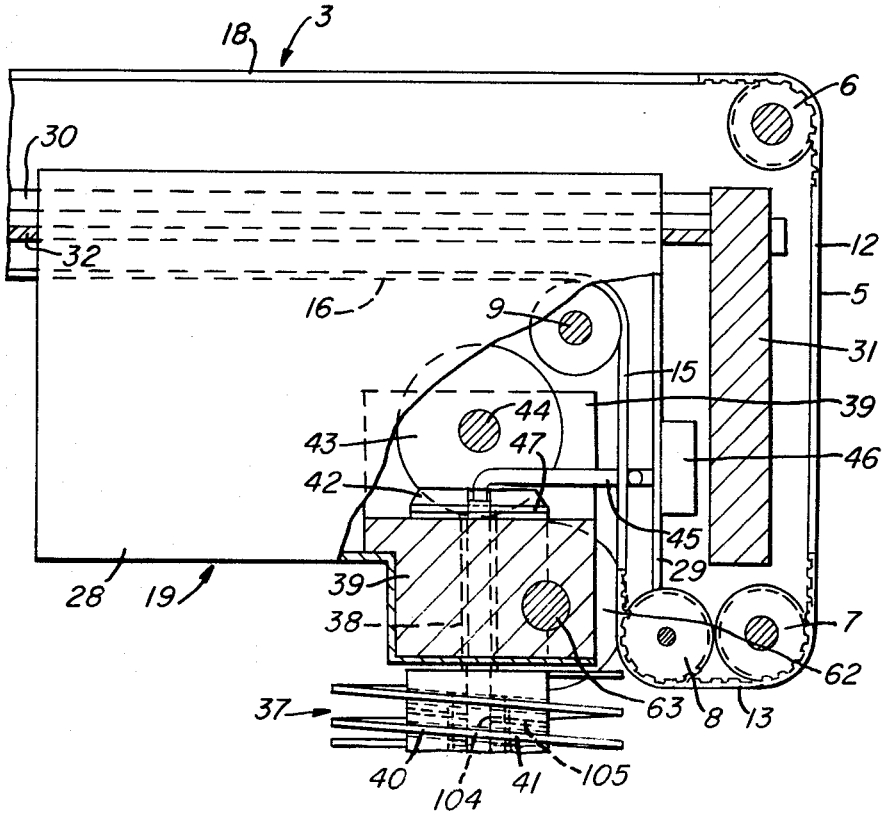
FIG. 3 is an enlarged side elevational view of a portion of the system in FIG. 1 which more clearly illustrates the strip guide conveyors of the present invention adjacent the spiral fold conveyors.

Still further the invention herein includes a means for providing an air cushion interface between the strip 57 and adjacent surfaces of the flight 40 for further reducing friction and mechanical interference as the strip 57 is conveyed downwardly by the spiral assemblies 37. An arrangement to achieve this air cushioning is best illustrated in FIG. 3 wherein a transversely extending duct 45 is in communication between a suitable fluid pressure source, schematically shown at 46, and a vertically extending upwardly open passageway 104 within shaft 38. A suitable coupling 47 is provided adjacent the upper ends of each shaft 38 for securing the transverse ends of the stationery duct 45 to the rotating shafts 38. Suitable radial passageways 105 are provided which communicate between the passageway 104 and the exterior of shaft 38. If desired, the flight 40 may be hollow and provided with generally vertically directed openings therein with passageways 104 communicating between passageway 105 and the interior of the hollow flight 40. With such structure at least a portion of the periphery of shaft 38 and/or flight 40 is provided with an air cushion intermediate the strip 57 and a portion of spiral assemblies 37 adjacent thereto thereby decreasing frictional resistance and mechanical interferences with respect to the strip 57 as it is conveyed downwardly and folded by the spiral assemblies 37.

Each transversely spaced pair of spiral conveyor assemblies 37 are suitably driven in a synchronous manner. FIG. 3 illustrates a synchronous driving arrangement where each shaft 38 carries a bevel gear 42 adjacent the upper end thereof. A transversely extending drive shaft 44 carrying transversely spaced bevel gears is positioned adjacent the upper portion 48 of bearing block 39 in a manner that each gear 43 is in toothed engagement with a respective bevel gear 42. One axial end portion of drive shaft 44 extends outwardly from a side support 1 and has a chain wheel 50 secured thereto. Chain wheel 50 is a portion of the primary drive chain assembly 106 which will be more completely described hereinafter.

Figure 2:
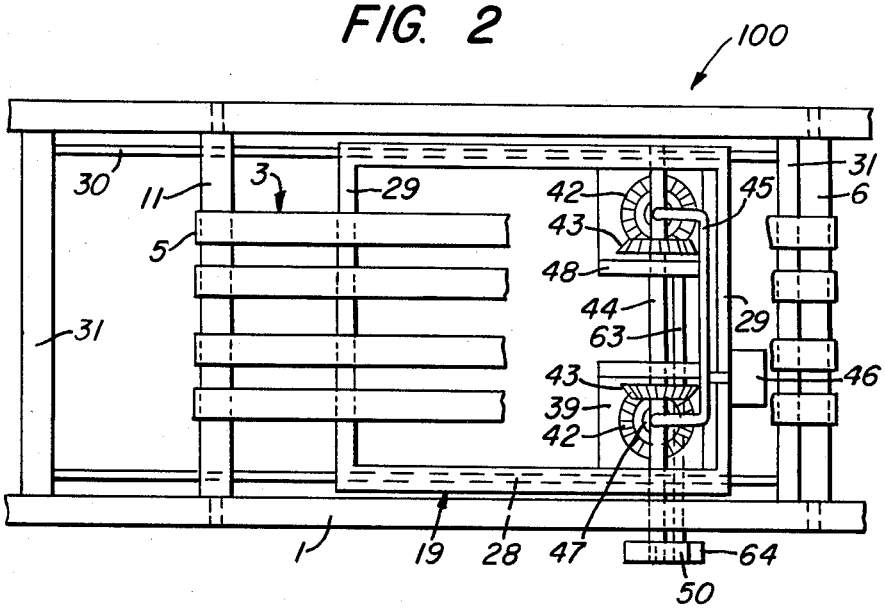
FIG. 2 is an enlarged partial plan view taken on lines II—II of FIG. 1 which more clearly illustrates the strip guide conveyors of the present invention.

As best illustrated in FIG. 2, longitudinally spaced forward and rearward stationery carrier plates 31 extend transversely between side supports 1. Longitudinal extending transversely spaced support and guide rails 30 extend through end panels 29 adjacent the upper ends thereof and have the respective axial ends thereof secured to plates 31 adjacent the upper ends thereof. Such an arrangement of guide rails 30 and carrier plates 31 provide vertical and transverse support for slide guide 19 as well as providing a guiding means in rails 30 for the longitudinal adjusting movement of slide guide 19.

Means for selectively moving slide guides 19 longitudinally along rails 30 are provided as a pair of transversely spaced longitudinally extending shafts 32 which have the forward ends thereof secured to the forward end panel 29 of slide guide 19 and extend rearwardly therefrom through the rearward end panel 29 and through the rearward carrier plate 31. The rear end portion of each shaft 33 is respectively threadably received through a coaxially aligned bevel gear 33. Bevel gear 33 is in toothed engagement with a ninety degree oriented bevel gear 34 which is rotatable on a transverse shaft 35. Shaft 35 extends through the far side support 1 and is journaled to a handwheel 36. Adjustments of the longitudinal spacing between longitudinal spaced pairs of spiral conveyor assemblies 37 is provided by turning the handwheel 36 to move slide guide 19 in either longitudinal direction, as desired, along rails 30.

Drive for rotative power to the spiral conveyor assemblies 37 is provided by the primary chain drive assembly 106. Drive assembly 106 additionally provides power to the roller 7 for frictionally driving the endless belts 5 of the conveyor assemblies 3.

Drive assembly 106 is driven by means of an endless chain 25 which orbits about an output shaft 26 of a motor 27 carried adjacent the upper end of side body members 1 and a chain wheel 74 which is mounted on a rotatable shaft 24 which extends between side supports 1. Drive assembly 106 comprises: an upper chain wheel 52 carried by shaft 24; a lower chain wheel 50 in substantially vertical alignment with chain wheel 52 and carried by the shaft 44 which drives and times the spiral conveyor assemblies 37; an intermediate chain wheel 75 vertically intermediate chain wheels 50 and 52, displaced slightly rearwardly therefrom and carried by an arm 76 which is pivotable about forwardly spaced shaft 77; and a rearwardly spaced tensioning chain wheel 53 which is carried by a piston rod 54 which is selectively reciprocable within a tensioning cylinder 55. An endless drive belt 51 is trained about chain wheels, piston 54 is extended or retracted to maintain a constant tension in the belt 51. Furthermore inasmuch as chain wheel 75 exerts a pressure on belt 51 independent of the piston 54, the inclination of arm 76 may be selectively adjusted by suitable means (not shown) for additional drive control.

With such drive assembly 106 the motor 27 is energized to rotate shaft 26. The drive chain 25 from shaft 26 will rotate shaft 24 which in turn will drive the belt 51. The belt 51 rotates the chain wheel 50 to impart driving force to the spiral conveyor assemblies 37. Furthermore, although not specifically shown, an additional drive assembly 106 is carried on the left hand portion of the system 100 as is illustrated in FIG. 1. This additional drive assembly 106 is driven by a chain 107 also in communication with shaft 26 of motor 7. Accordingly since both drive assemblies 106 are driven from the common shaft 26, all four spiral conveyor assemblies 37 are synchronized.

Drive assembly 106 drives conveyor assemblies 3 by means of a chain 21 which extends between a shaft 22 carrying a gear 14 and a toothed wheel 20 which is carried by roller 7 adjacent one axial end thereof. Gear 14 is in toothed engagement with the chain wheel 52. Since both drive assemblies 106 are driven from the common shaft 106, the orbits of the belts 5 of both conveyor assemblies 3 are synchronized as well as being synchronized with the four spiral conveyor assemblies 37.

The invention herein additionally teaches rotatable brush 62 for aiding the strip 57 in the travel thereof to the flight 40 by loosening the strip from runs 13, by further directing such strip 57 toward the entry of spiral conveyors 37 and by aiding the spiral conveyors 37 in the initial fold or rounding along the respective indent. Specifically for this purpose and as is schematically illustrated in FIG. 3, at least a transversely spaced pair of rotatable brushes 62, one of which is positioned inwardly adjacent each respective spiral conveyor 37, are carried on each shaft 63 rearwardly adjacent roller 8. Brushes 62 are formed in a semi-circular or crescent configuration and are dimensioned such that the path of outer periphery of the crescent will slightly overlap the path of the belts 5 upwardly adjacent the run 13 and will extend downwardly during at a point intermediate the upper entry portion of the spiral conveyors 37. Brush 62 is driven by means of a chain 65 which extends between a chain wheel 64 carried on shaft 63 and a chain wheel 66 carried on spiral conveyor drive shaft 44. Once again because of the common driving arrangement the rotation of each brush 62 is synchronized not only with each other but also with the spiral conveyor assemblies 37 and the conveyor assemblies 3. The rotation of brushes 62 are further timed such that brushes 62 engage the strip 57 substantially at the moment that a respective indent is adjacent the innermost portion of the entry of a respective spiral conveyor 37. Thus, with such a structure, location and timing arrangement, brushes 62 loosen the strip 57 from runs 13 by guiding the strip 57 toward the entry of spiral conveyors 37 and further apply a rearwardly directed sweeping force to strip 57 to aid spiral conveyors 37 in the initial folding along the indent.

Subsequent to folding, the strip 57 drops in an overlying fashion to the exit conveyor assembly 102 of the present invention. Exit conveyor assembly 102 includes an endless longitudinally extending belt 108 having an upper run 67 which tapers slightly upwardly to an uppermost point spaced downwardly from a transversely spaced pair of spiral conveyor assemblies 37, tapers downwardly therefrom to a point spaced downwardly from the other transversely spaced pair of spiral conveyor assemblies 37 whereat the belt 108 drops suddenly downwardly at step 70 to a lower exit run 68. Step 70 is formed by training belt 108 about idler rollers 71 which are suitably journaled in a slide 72. Slide 72 is slidable or rendered adjustable longitudinally on rails 73 in any suitable manner. The longitudinal adjustment of slide 72 will permit step 70 to be in the proper orientation below a transversely spaced pair of spiral conveyors 37 even if conveyors 37 are moved longitudinally to allow for differing length folds in strip 57. Inclusion of the stepped configuration of exit conveyor assembly 102 allows for a more efficient flow of overlying folded strip 57 as well as providing a means for somewhat compacting the folded strip prior to exit.

Additional features of the strip conveying and folding system 100 of the present invention which have not been mentioned in detail hereinbefore include the fact that all rollers 6–11 are toothed and are in toothed engagement with the underside of transverse corrugations in the belts 5. Such an arrangement is quite efficient and reduces the tension necessary to drive belts 5 in the orbits thereof. Accordingly, the rollers 5 of the present invention may have a lesser section modulus than was present in the rollers of some folding and conveying systems utilized heretofor. Furthermore in the preferred embodiment illustrated in FIG. 1, the upper ends of adjacent runs 12 are in slight engagement for a more positive drive of strip 57. The runs 12 taper slightly and are spaced at the adjacent lower ends thereof. Still further the side body members 100 include openings 49 adjacent the lower forward end portions thereof to provide space for viewing and to facilitate certain equipment positioning.

A still further feature of the strip conveying and folding system 10 of the present invention is the inclusion of operational and structural characteristics wherein an air cushion is substantially continuously maintained on either side of the strip 57 during the downward conveyance thereof between the adjacent vertically extending runs 12. The maintenance of this air cushion provides for smoother and more consistent operating characteristics and also inhibits the tendency of smearing the printed indecia on the strip 57 during the downward conveyance thereof to the spiral conveyor assemblies 37. Such an air cushion is provided and operationally maintained by choosing the surface speed of the belts 5 in the range of 1.4 to 2.0 times the strip surface speed with a particularly preferred belt speed being substantially 1.7 times the strip surface speed.

The invention herein is to a strip conveying and folding system as is defined by the claims hereinafter. Accordingly it is contemplated that one skilled in the art can make modifications to the preferred embodiment discussed hereinabove without departing from the scope of the invention; for example: roller 10 and run 17 may be dispensed with if roller 9 is shifted upwardly to a point adjacent the upper end of slide 19 in substantial longitudinal alignment with roller 11, thus having run 16 extending between rollers 9 and 17; adjacent runs 12 may be in engagement or spaced from each other the entire lengths thereof; spiral conveyor assemblies 37 may be carried by slides 19 in a manner that they are adjustable independently of the slide 19; roller 10 may be dispensed with by increasing the diameter of roller 11; strip 57 need not necessarily have transverse indents or corrigations therein; and the like.

What is claimed is:

1. A paper strip folding and conveying system for zig-zag folding of a continuously flowing strip of paper to produce a stack of overlying folds, such as a series of business forms, comprising: a plurality of longitudinally spaced continuously orbiting first conveying means for conveying and guiding such strip downwardly between respective vertically extending forward conveyor runs toward longitudinally spaced second conveying means; said second conveying means being sets of conveying and folding spirals spaced rearwardly from respective ones of said forward conveyor runs for producing such overlying folds and simultaneously conveying such strip downwardly; said first conveying means each including a generally horizontally and longitudinally extending transverse conveyor run having a forward end thereof adjacent a lower end of a respective forward conveyor run and extending horizontally therefrom to a rearward end thereof which is adjacent an upper end of a respective second conveying means, said transverse conveyor runs being operable to aid in the conveying and guiding of such strip from said forward conveyor runs to said second conveying means; and adjusting means cooperable with at least one of said first conveying means to selectively adjust the longitudinal spacing between said second conveying means while simultaneously adjusting the longitudinal extent of said transverse conveyor run of said one of said first conveying means an equivalent amount.

2. A paper strip folding and conveying system as specified in claim 1 wherein said adjusting means are cooperable with all of said longitudinally spaced first conveying means to selectively adjust the longitudinal spacing between said spiral conveyor means while simultaneously adjusting the longitudinal extent of said transverse conveyor runs an equivalent amount.

3. A paper strip folding and conveying system as specified in claim 2 wherein each of said first conveying means comprises an endless belt trained about a plurality of transversely extending elongated rollers to define the respective conveyor runs thereof.

4. A paper strip folding and conveying system as specified in claim 3 wherein said first conveying means each include a rear generally vertically extending conveyor run rearwardly spaced from said forward conveyor run, having the lowermost ends thereof adjacent the respective rearward end of said transverse conveyor run and extending upwardly therefrom.

5. A paper strip folding and conveying system as specified in claim 4 wherein the ones of said rollers which define said rear conveyor run are carried by a respective longitudinally movable portion of said adjusting means.

6. A paper strip folding and conveying system as specified in claim 5 wherein said spiral conveying means are additionally carried by said respective longitudinally movable portion of said adjusting means.

7. A paper strip folding and conveying system as specified in claim 4 wherein said rollers include elongated teeth thereon which are in toothed engagment with the underside of said belt for the driving of said belt and said teeth are elongated in the direction of elongation of said rollers.

8. A paper strip folding and conveying system as specified in claim 2 additionally including longitudinally extending exit conveyor means spaced downwardly from said spiral conveyor means and cooperable with said spiral conveyor means to receive such folded strip thereon and convey such strip to discharge therefrom.

9. A paper strip folding and conveying system as specified in claim 8 wherein said exit conveyor means includes a first longitudinally extending exit conveying run which extends towards said discharge and a step conveyor run which steps suddenly downwardly from the end of said first conveying run which is nearest said discharge to a second longitudinally extending exit paper conveying run which conveys such strip to said discharge, said step conveying run being spaced downwardly adjacent said spiral conveying means which is adjacent said discharge.

10. A paper strip folding and conveying system as specified in claim 9 additionally including step conveying run adjusting means operative to selectively move said step conveying run longitudinally.

11. A paper strip folding and conveying system as specified in claim 1 wherein said spiral conveying means includes a downwardly extending helical flight with the outer peripheral portion of an uppermost crown of said flight being at an elevation spaced upwardly from a downwardly facing surface of said transverse conveyor run.

12. A paper strip folding and conveying system as specified in claim 1 wherein said spiral conveying means each include a downwardly extending flight and additionally including cushioning means operative to direct pressurized air to portions of said flight to provide an air cushion intermediate at least some surfaces of said spiral conveying means and the adjacent surfaces of such strip which is being conveyed and folded thereby.

13. In a paper strip folding and conveying system wherein paper strip is alternately directed to a plurality of longitudinally spaced downwardly extending spiral conveying means and wherein the strip is conveyed downwardly by said spiral conveying means and simultaneously folded thereby in an overlapping accordion like fashion, the improvement comprising: said spiral conveying means each include a downwardly extending flight; and cushioning means operative to direct pressurized air to portions of said flight to provide an air cushion intermediate at least some surfaces of said spiral conveying means and adjacent surfaces of such strip which is being conveyed and folded thereby.

14. A method for conveying and zig-zag folding of a continuously flowing strip of paper to produce a stack of overlying folds, such as a series of business forms, and including a plurality of longitudinally spaced continuously orbiting first conveying means for conveying and guiding the strip downwardly between vertically extending portions thereof to longitudinally spaced second conveying means, the second conveying means being sets of conveying and folding spirals for producing such overlying folds and simultaneously conveying the strip downwardly, comprising: continuously maintaining an air cushion on the recto and verso sides of said strip during the downward travel thereof between said vertically extending portions.

15. A method as specified in claim 14 wherein said first conveying means orbit at an orbiting speed and said continuously maintaining of said air cushion is by maintaining the orbiting speed of said first conveying means during the downward travel thereof at 1.4 to 2.0 times the speed of said strip during the downward travel thereof between said vertically extending portions.

* * * * *

UNITED STATES PATENT AND TRADEMARK OFFICE

CERTIFICATE OF CORRECTION

PATENT NO. : 4,243,215

DATED : 6 January 1981

INVENTOR(S) : Marc F.S.M. Van den Bergh

It is certified that error appears in the above-identified patent and that said Letters Patent are hereby corrected as shown below:

In the cover sheet of the Patent under Item [30] "Foreign Application Priority Data", delete "September 15, 1976" and substitute therefor --"August 16, 1976"--

Signed and Sealed this

*Fourteenth* Day of *July 1981*

[SEAL]

*Attest:*

GERALD J. MOSSINGHOFF

*Attesting Officer*

*Commissioner of Patents and Trademarks*